United States Patent [19]

Sherosky

[11] 4,066,367

[45] Jan. 3, 1978

[54] BRUSH SHAVE DEVICE

[76] Inventor: Frank Sherosky, 29101 Hayes, Warren, Mich. 48093

[21] Appl. No.: 673,466

[22] Filed: Apr. 5, 1976

[51] Int. Cl.[2] ..... A46B 11/04; A47L 13/22

[52] U.S. Cl. ..... 401/286; 401/290; 401/270

[58] Field of Search ..... 401/41, 150, 268–271, 401/290, 286

[56] References Cited

U.S. PATENT DOCUMENTS

| | | | |
|---|---|---|---|
| 1,007,816 | 11/1911 | Stubenrauch | 401/269 X |
| 1,067,596 | 7/1913 | Fesler | 401/269 X |
| 1,072,322 | 9/1913 | Forster et al. | 401/271 |
| 1,725,464 | 8/1929 | Lysons | 401/269 X |
| 2,357,964 | 9/1944 | Marder et al. | 401/270 |

FOREIGN PATENT DOCUMENTS

| | | | |
|---|---|---|---|
| 895,257 | 5/1962 | United Kingdom | 401/269 |

*Primary Examiner*—Stephen C. Pellegrino
*Attorney, Agent, or Firm*—William L. Fisher

[57] ABSTRACT

Improvement in a brush shave device for dispensing liquid shaving soap from a bottle having a shaving brush carried thereon, the bottle having a neck, the shaving brush being of the type having a single tuft of bristles, the improvement comprising a tapered spout on the neck of the bottle, the bottle filled with liquid shaving soap, the spout not removeable from the neck so that the bottle is not re-fillable, the brush having an adhesive base in which the tuft of bristles is embedded, the adhesive base being a solid body and having some height thereto so as to have a tapered aperture therein for sealing against the taper on the spout, a joining member surrounding the adhesive base so that the tuft of bristles projects out of the upper end of the joining member, the lower end of the joining member removeably connected to the bottle for inserting and holding the brush thereon and removing the brush therefrom, the upper end of the spout projecting above the adhesive base and into the bristles less than half the height thereof, and a cap for the spout for sealing the bottle when the device is being transported.

1 Claim, 8 Drawing Figures

BRUSH SHAVE DEVICE

My invention relates to wet shaving.

The principal object of my invention is to provide improvements in a brush shave device for wet shaving which, inter alia, enhances its utility.

The foregoing object of my invention and the advantages thereof will become apparent during the course of the following description, taken in conjunction with the accompanying drawings, in which.

Figure 1:
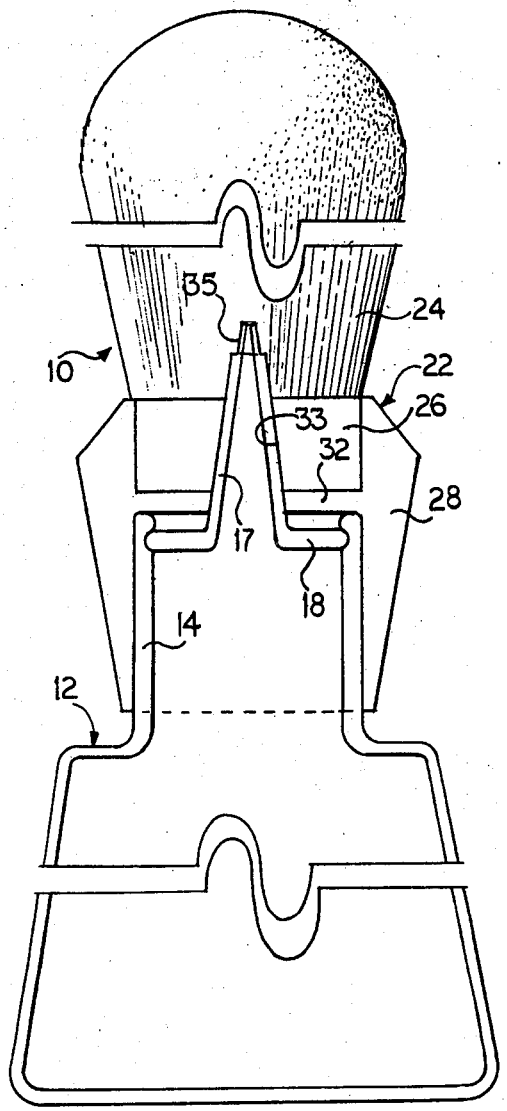
FIG. 1 is a vertical sectional view of a brush shave device embodying my invention.

Referring to the drawings in greater detail and first to the embodiment shown in FIG. 1, 10 generally designates the same which comprises a squeeze-type bottle 12 for holding liquid shaving soap. Said bottle 12 is non-refillable and provided with a neck with a conical spout 17 having a base 18 which is permanently sealed in place on the neck 14 as shown after factory filling of the bottle 12 with shaving soap. A shaving brush 22 having bristles 24, an adhesive base 26 and a finished plastic base 28 fits over the neck 14. The base 26 is cemented in the base 28 and has its bottom resting against a flange 32 formed in the base 28. Said spout 17 has an outlet aperture in a reduced end portion 35 thereof which may be covered with a removeable cap for transporting the device 10 with the brush 22 in place on the bottle 12. A central inverted conical aperture 33 corresponding to the spout 17 is formed in the base 26 and flange 32. The brush shave device 10 may be transported with the brush 22 in place on the bottle 12 so long as the cap is in place on the spout 17. In use of the brush shave device 10 the cap is removed and the device 10 inverted and the bottle 12 squeezed so that shaving soap will enter the bristles 24, whereby the user can lather his face for shaving. When the bottle 12 is emptied it may not be refilled but another re-fill bottle 12 may be used with the brush 22.

Figure 2:
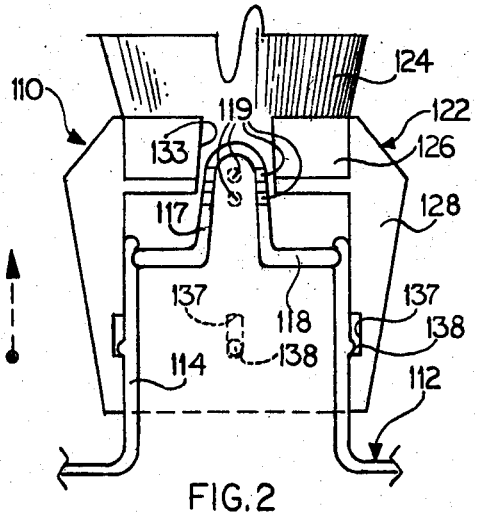
FIGS. 2 and 3 are fragmentary vertical sectional views of another embodiment of my invention.
Figure 3:
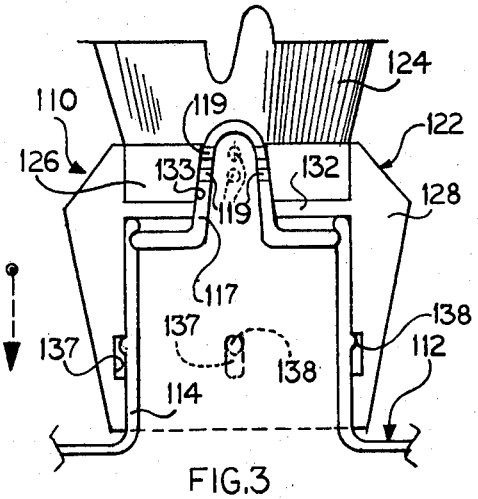

Referring to FIGS. 2 and 3, the embodiment shown therein is designated 110 and comprises a bottle 112 and shaving brush 122. The spout of the bottle 112, which is designated 117, has apertures 119 formed in the side walls thereof which are either open or closed depending upon the position of the brush 122 on the bottle 112. The base 128 is provided with a pair of diametrically disposed slots 137 and the neck 114 is provided with pins 138 which operate in said slots 137. The slots 137 are vertical so that the brush 122 can be raised or lowered on the bottle 112 to open or close the apertures 119. The brush shave device 110 may likewise be transported with the brush 122 in place on the bottle 112 so long as the brush 122 is in its lowered position on the bottle 112. In use of the brush shave device 110 the brush 122 is pulled upwardly to its raised position and the bottle 112 inverted and squeezed so that shaving soap will be dispensed into the bristles 124 as in the prior embodiment. When the bottle 112 is emptied of its contents it may be squeezed, as it is sufficiently flexible for this purpose, so that the brush 122 can be pulled off the bottle 112 over the pins 138 and the brush 122 inserted on a re-fill bottle.

Figure 4:
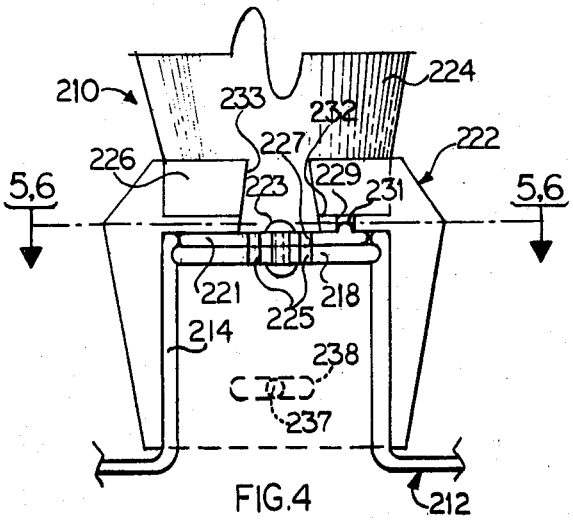
FIG. 4 is a fragmentary vertical sectional view of still another embodiment of my invention.
Figure 5:
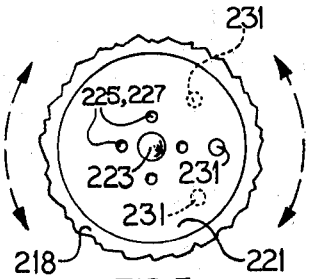
FIGS. 5 and 6 are fragmentary top plan views of the structure of FIG. 4 taken, respectively, on the line 5—5; 6—6 thereof.
Figure 6:
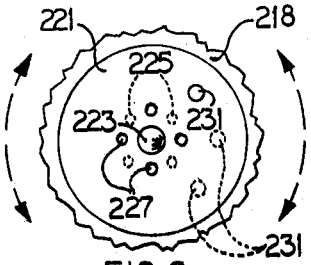

Referring to FIGS. 4–6, the embodiment shown therein is designated 210 and comprises a bottle 212 and shaving brush 222 which are provided, respectively, with diametrically disposed pins 237 and slots 238. The slots 238 are horizontal so that the brush 222 is rotatable in respect to the bottle 212. The bottle 212 is provided with a disk 218 which is cemented to the neck 214 and carries another moveable disk 221 via a rivet 223 which moveably joins both disks 218 and 221 together. A detent 231 upstands from the disk 221 and is disposed in an aperture 229 formed in the flange 232 so that upon rotation of the brush 222 the disk 221 rotates in respect to the disk 218. When the brush 224 is in one rotated position on the bottle 212 as shown in FIGS. 4 and 5 (in which the pin 237 is centered in the slot 239) the apertures 225 and 227 are aligned with each other so that shaving soap can be dispensed from the bottle 212 into the brush 222. This is the in-use position of the brush shave device 210. In this position the device 210 is inverted in use and the bottle 212 squeezed to dispense shaving soap through the valve consisting of the disks 218 and 221 into the bristles 224 of the brush 222. When the brush 222 is in either extreme rotated position in respect to the bottle 212 as shown in FIG. 6 (in which the pin 237 is at an end of the slot 239) the apertures 227 are not aligned with the apertures 225 and no dispensing of shaving soap can take place. In this position of the brush 222 the brush shave device 210 can be transported with the brush 222 in place on the bottle 210.

Figure 7:
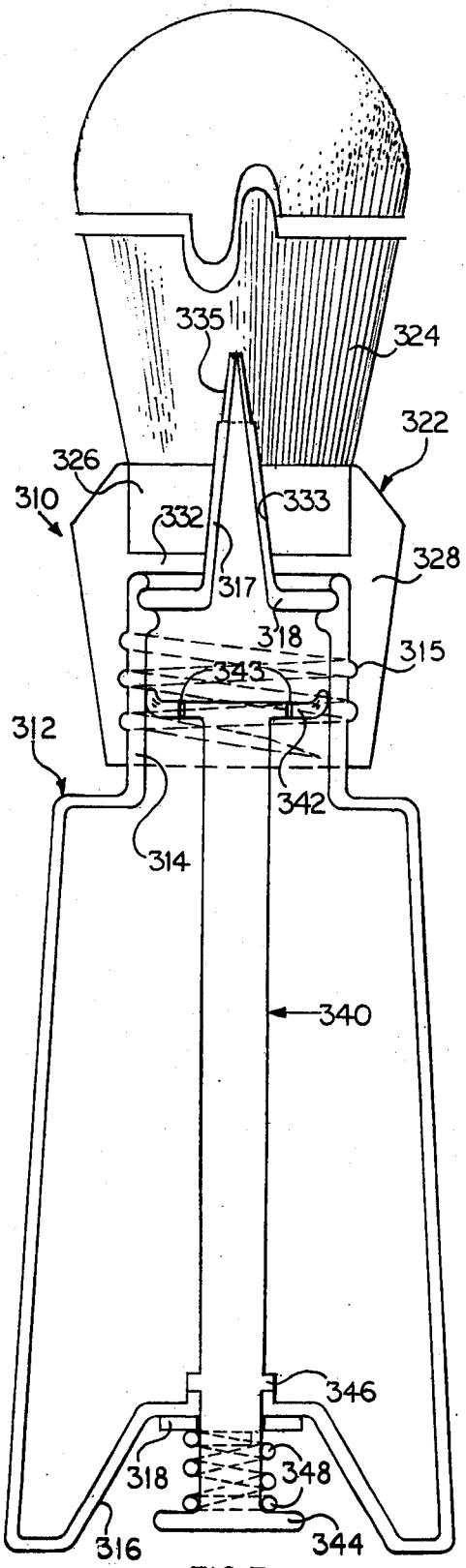
FIG. 7 is a vertical sectional view of a further embodiment of my invention.

Referring to FIG. 7, the embodiment shown therein is designated 310 and comprises a bottle 312 and shaving brush 322 which are threadably joined, as at 315. The bottle 312 is provided with a spout 317 having a reduced end portion 335 for receiving a cap. The spout 317 projects through the aperture 333 in the base 326 and flange 332 so that its outlet aperture is disposed in the bristles 324 for dispensing shaving soap as in the prior embodiments. Said bottle 312 is also provided with a manually operable plunger 340 having a piston 342 operative in the neck 314. Said piston 342 has apertures 343 therethrough and is arranged to be loose fitting in the neck so that shaving soap will pass therethrough and therearound when the brush shave device 310 is inverted. The outer end of the plunger 340 is flanged, as at 344, to serve as a thumb press and to contain one end of a compression spring, 348, the other end of which bears against a washer 318. The brush shave device 310 may be transported with the brush 324 in place on the bottle 312 so long as the cap is in place on the spout 317. In use of the brush shave device 310 the cap is removed and the brush shave device 310 is inverted to cause shaving soap to move in front of the piston 342 and the plunger 340 is pushed upon with the user's thumb to dispense shaving soap out of the spout 317 into the bristles 324. While some of the shaving soap in front of the piston 342 is forced rearwardly therearound and therethrough via said apertures 343, most of it is dispensed out of the spout 317; the apertures 343 and loose fit of said piston 342 serve as pressure relief means.

Figure 8:
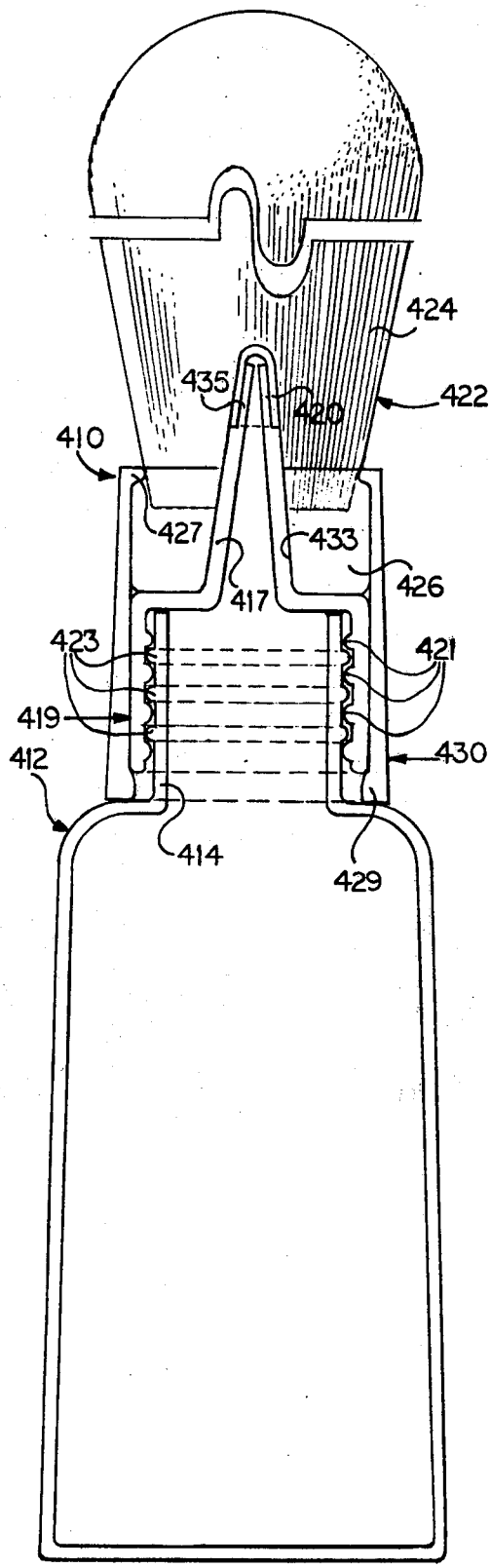
FIG. 8 is a vertical sectional view of a still further embodiment of my invention.

Referring to FIG. 8, the embodiment shown therein is designated 410 and comprises a bottle 412 and shaving brush 422 which has only an adhesive base 426 which decreases the cost of said brush 422. The bottle 412 is provided with a cover 419 which snaps over and is permanently joined to the neck 414 via non-threading interlocking rings 421 and 423 on said neck 414 and cover 419, respectively. Said cover 419 has a conical spout 417 provided with a reduced end portion 435 (which, in the instance, is shown covered with a cap 420). The spout 417 projects through the aperture 433 in the base 426 as in the prior embodiments. A joining member 430 is used to hold the brush 422 in place on the bottle 412 and for this purpose is provided with shoulders 427 and 429 on opposite ends thereof. The brush 422 is first inserted into and threaded through the upper end of said member 430 until the shoulder 427 bears against the upper edge of said base 426. The lower end of said member 430 is then forced downwardly over the cover 419 until the shoulder 429 on said member 430 snaps into place below the lower edge of said cover 419. In use of said brush shave device 410 the same is inverted and squeezing of the bottle 412 dispenses shaving soap into the bristles 424 as in the prior embodiments.

In use of the devices 10, 310 and 410 the respective cap may be inserted on or removed from the respective end portion 35, 335 and 435 when the respective brush 22, 322 and 422 is first removed from the respective bottle 12, 312 and 412. Because of the construction of the respective end portion 35, 335 and 435 removal of the respective brush 22, 322 and 422 from or insertion on the respective bottle 12, 312 and 412 is accomplished with the same facility whether the respective cap is in place on or removed from the respective spout 17, 317 and 417.

It will thus be seen that there has been provided by my invention improvements in a brush shave device in which the object hereinabove set forth, together with many thoroughly practical advantages, has been successfully achieved. While preferred embodiments of my invention have been shown and described, it is to be understood that variations and changes may be resorted to without departing from the spirit of my invention as defined by the appended claims.

What I claim is:

1. Improvement in a brush shave device for dispensing liquid shaving soap from a bottle having a shaving brush carried thereon, the bottle having a neck, said shaving brush being of the type having a single tuft of bristles, said improvement comprising a tapered spout on the neck of the bottle, said spout having a flat platform portion formed thereon, said bottle being a squeeze type bottle and filled with liquid shaving soap, so that the same sprays from said spout to saturate said bristles, means for attaching the spout to the bottle so that said spout is not removeable from said neck and so that the bottle is not re-fillable, the brush having an adhesive base in which said tuft of bristles is embedded, said adhesive base being a solid body and having some height thereto so as to have a tapered aperture therein for sealing against the taper on said spout, a joining member surrounding the adhesive base so that the tuft of bristles projects out of the upper end of said joining member, said joining member having a flange on its upper end which is smaller in diameter than that of said adhesive base and engages the upper end of said adhesive base, means on the lower end of said joining member for removeably connecting the same to the bottle, the upper end said spout projecting above said adhesive base and into the bristles less than half the height thereof, the bottom of said adhesive base bottoming directly upon the platform portion of said spout when the brush is inserted and held on said bottle, said attaching means for the spout constructed so that said spout remains affixed to the bottle when the joining member is removed for removing the brush, and a cap for said spout for sealing the bottle when the device is being transported.

* * * * *